US008575863B2

(12) United States Patent
Cai et al.

(10) Patent No.: US 8,575,863 B2
(45) Date of Patent: Nov. 5, 2013

(54) COLOR CORRECTING DEVICE DRIVER

(75) Inventors: Charles Cai, San Jose, CA (US); Jeff Kotowski, Nevada City, CA (US); Timothy James Herklots, Cupertino, CA (US)

(73) Assignee: Atmel Corporation, San Jose, CA (US)

( * ) Notice: Subject to any disclaimer, the term of this patent is extended or adjusted under 35 U.S.C. 154(b) by 175 days.

(21) Appl. No.: 13/291,943

(22) Filed: Nov. 8, 2011

(65) Prior Publication Data

US 2013/0113381 A1 May 9, 2013

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl.

USPC ..... 315/307; 315/247; 315/224; 315/185 S; 315/312

(58) Field of Classification Search

USPC ..... 315/247, 185 S, 224, 307–326

See application file for complete search history.

(56) References Cited

U.S. PATENT DOCUMENTS

| | | | | |
|---|---|---|---|---|
| 8,054,008 | B2 * | 11/2011 | Kimura | 315/307 |
| 2011/0128303 | A1 * | 6/2011 | Yonemaru et al. | 345/690 |
| 2012/0249005 | A1 * | 10/2012 | Jin et al. | 315/206 |
| 2013/0082621 | A1 * | 4/2013 | Kotowski et al. | 315/294 |
| 2013/0147358 | A1 * | 6/2013 | Kotowski et al. | 315/122 |

* cited by examiner

*Primary Examiner* — Jany Richardson
(74) *Attorney, Agent, or Firm* — Fish & Richardson P.C.

(57) ABSTRACT

A color correcting device driver is configured to vary the equivalent current into light emitting elements (e.g., LEDs) with the frequency of the AC input current (e.g., 120 Hz). In implementations that include a fly-back controller with a power factor correction (PFC) controller on the primary side, the color correcting device driver performs the method of: 1) turning on the loads (e.g., white and CA strings of LEDs); 2) determining if the voltage supplied to the loads has dropped by a first threshold amount; 3) turning off the loads; and 4) determining if the voltage supplied to loads has recovered by a second threshold amount (or waiting for a fixed amount of time). The method is repeated. In implementations that do not include a PFC controller on the primary side, the color correcting device driver can create a pulse width modulated (PWM) signal.

18 Claims, 4 Drawing Sheets

COLOR CORRECTING DEVICE DRIVER

TECHNICAL FIELD

This disclosure relates generally to electronics and more particularly to driving light emitting elements.

BACKGROUND

The output color of a white Light Emitting Diode (LED) has some deficiencies in the form of reduced color in some parts of the visible spectrum. To correct for the white LED deficiencies a second "color adjust" (CA) LED string is used to fill in the spectrum in the areas where the white string is deficient. The combination of the white LED string and the CA LED string produce a pleasing white output. Due to increased demand for low cost solutions for various LED lighting applications, color correcting device drivers must now be designed with fewer or less expensive components.

SUMMARY

A color correcting device driver is configured to vary the equivalent current into light emitting elements (e.g., LEDs) with the frequency of the AC input current (e.g., 120 Hz). In implementations that include a fly-back controller with a PFC controller on the primary side, the color correcting device driver performs the method of: 1) turning on the loads (e.g., white and CA strings of LEDs); 2) determining if the voltage supplied to the loads has dropped by a first threshold amount; 3) turning off the loads; and 4) determining if the voltage supplied to the loads has recovered by a second threshold amount (or waiting for a fixed amount of time). The method is then repeated.

In implementations that do not include a PFC controller on the primary side, the color correcting device driver can create a pulse width modulation (PWM) signal by detecting the starting point for a sine wave PWM approximation and starting the PWM approximation at the correct frequency. In some implementations, an inductor in series with the CA string is removed and the CA string is driven linearly.

Particular implementations of a color correcting device driver can provide several advantages, including but not limited to: 1) power factor correction; 2) high efficiency; 3) long product life time; 4) reduced size for capacitor used to compensate for current supplied by the PFC controller; 5) removal of the inductor that is connected in series with the CA string; and 6) removal of the recirculating diode that is connected in parallel with the CA string.

The details of one or more disclosed implementations are set forth in the accompanying drawings and the description below. Other features, aspects, and advantages will become apparent from the description, the drawings and the claims.

DETAILED DESCRIPTION

Overview of Color Correcting Device Driver

Figure 1:
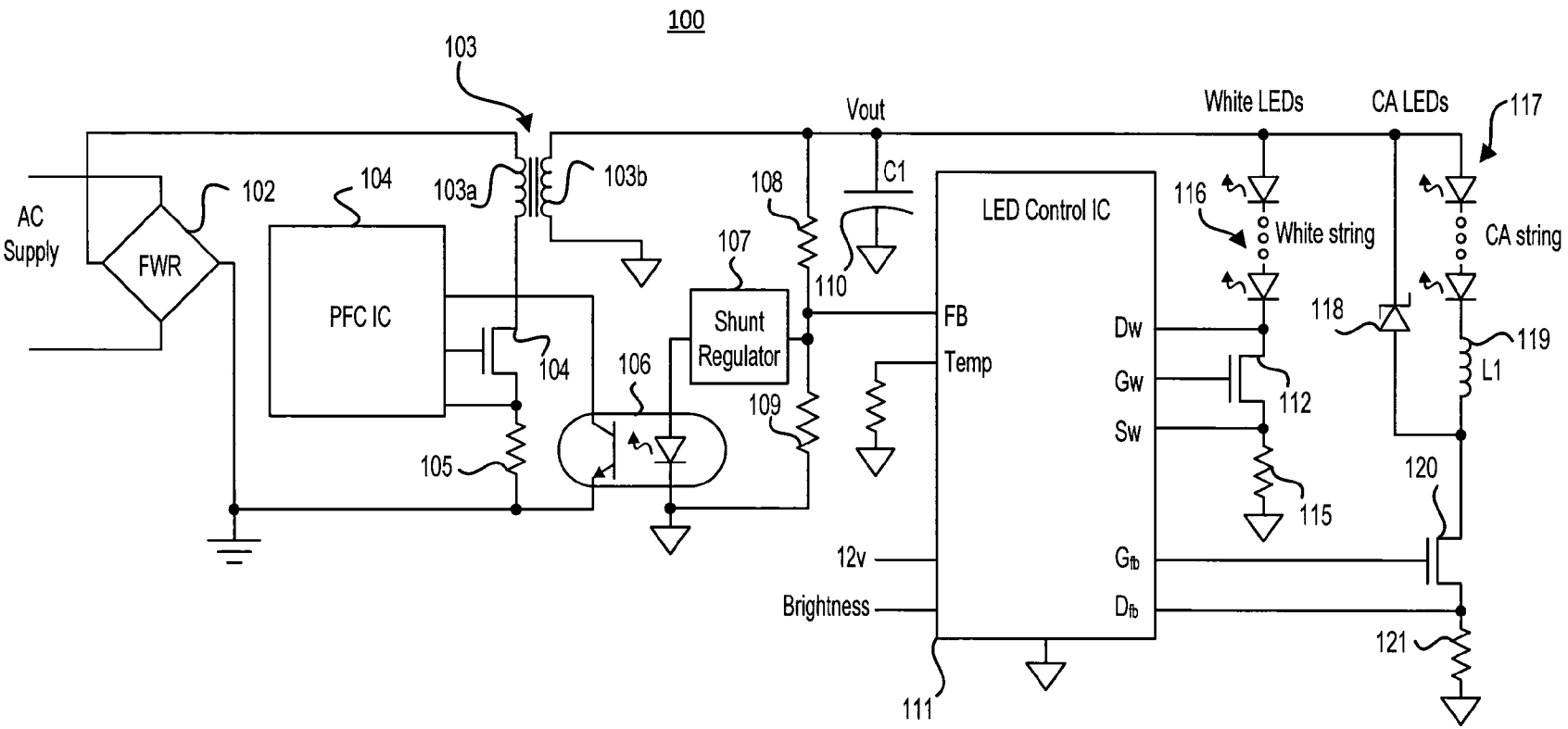
FIG. 1 is a simplified schematic diagram of an exemplary color correcting device driver for driving lighting elements with constant current.

FIG. 1 is a simplified schematic diagram of a color correcting device driver 100 for driving illuminating elements (e.g., LEDs) with constant current. In some implementations, device driver 100 can include full-wave rectifier (FWR) 102, power factor corrector (PFC) controller 104, transformer 103 (having primary coil 103*a* and secondary coil 103*b*), transistor 104, sense resistor 105, opto-coupler 106, shunt regulator 107, resistors 108, 109, capacitor 110 (C1), device controller 111, transistor 112, sense resistor 115, white string 116, CA string 117, recirculating diode 118, inductor 119 (L1), transistor 120 and sense resistor 121.

The number of strings 116, as well as the number of elements in each string, may depend on the particular type of device and application. For example, the device driver technology described here can be used, for example, in backlighting and solid-state lighting applications. Examples of such applications include LCD TVs, PC monitors, specialty panels (e.g., in industrial, military, medical, or avionics applications) and general illumination for commercial, residential, industrial and government applications. The device driver technology described here can be used in other applications as well, including backlighting for various handheld devices. The device driver 100 can be implemented as an integrated circuit fabricated, for example, on a silicon or other semiconductor substrate.

An AC input voltage (e.g., sinusoidal voltage) is input to FWR 102, which provides a rectified AC voltage. PFC controller 104 is configured to convert the rectified AC voltage on the primary side of transformer 103 to a DC voltage (Vout) on the secondary side of transformer 103, for driving strings 116, 117. PFC controller 104, together with transistor 104 and sense resistor 105 assures that the current drawn by strings 116, 117 is in the correct phase with the AC input voltage waveform to obtain a power factor as close as possible to unity. By making the power factor as close to unity as possible the reactive power consumption of strings 116, 117 approaches zero, thus enabling the power company to efficiently deliver electrical power from the AC input voltage to strings 116, 117.

Capacitor 110 compensates for the current supplied by PFC controller 104 by holding a DC voltage within relatively small variations (low ripple) while the load current is approximately DC and the current into capacitor 110 is at twice the frequency of the AC input voltage. When the AC input voltage is zero, the current in secondary coil 103*b* goes to zero and capacitor 110 provides the current for strings 116, 117. To keep the DC ripple low, a large electrolytic capacitor often is used, which can be unreliable, costly and have a limited life span.

Resistors 108, 109 form a voltage divider network for dividing down Vout before it is input to the feedback (FB) node of device controller 111 and shunt regulator 107. Device controller 111 forces current out of the FB node to regulate the Dw node at a desired level (typically 1V). Shunt regulator 107 acts as a reference for the feedback loop and provides current to opto-coupler 106. Recirculating diode 118 (e.g., a Schottky diode) recirculates current from CA string 117 when the PWM on the gate of transistor 120 is turned off.

In the circuit configuration shown, white string 116 uses most of the power CA string 117 uses a smaller amount of power to fill in the color spectrum. For example, white string 116 may require approximately 40 volts and 350 mA (14 watts), while CA string 117 requires approximately 20V and 150 mA (3 watts).

Device controller 111 resides on the secondary side of transformer 103. Device controller 111 is coupled to the drain, gate and source terminals of transistor 112 through nodes Dw, Gw and Sw. Device controller 111 is further coupled to the drain and source terminals of transistor 120. Device controller 111 sets the voltage and current through white string 116 by commanding transistor 112 (e.g., MOSFET transistor) on and off using a PWM waveform (e.g., applied to the gate of transistor 112 through node Gw) with a suitable duty cycle. The current is set by an amplifier loop in device controller 111 (not shown) by controlling the voltage across sense resistor 115. The voltage across white string 116 is controlled by measuring the drain voltage (Dw) of white string 116 and feeding back a current into the feedback node (FB) such that the drive (transistor 112 and sensor resistor 115) has just enough headroom to supply the required continuous current to strings 116, 117.

Similarly, device controller 111 sets the voltage and current through CA string 117 by commanding transistor 120 (e.g., MOSFET transistor) on and off using a PWM waveform (e.g., applied to the gate of transistor 120 through node Gfb) having a suitable duty cycle. The current is set by an amplifier loop in device controller 111 (not shown) by controlling the voltage across sense resistor 121. The voltage across CA string 117 is controlled by measuring the drain voltage (Dw) of CA string 117 at node Dfb. Since CA string 117 has a lower voltage than white string 116, a floating buck configuration can be used to regulate the current in inductor 119 (L1) to regulate the current in CA string 117. Internal to device controller 111 is a look-up table for adjusting CA string 117 brightness as a function of temperature.

Circuit 100 provides power factor correction, high efficiency and a long product life, but also has deficiencies in that capacitor 110 is extremely large, both physically and in value. This adds cost and space to the design. The large capacitor 110 also has a shorter useful life span. Additionally, inductor 119 used in the floating buck is both large in value and physically large, adding cost to the design.

Replacing Large Capacitor C1

Figure 2:
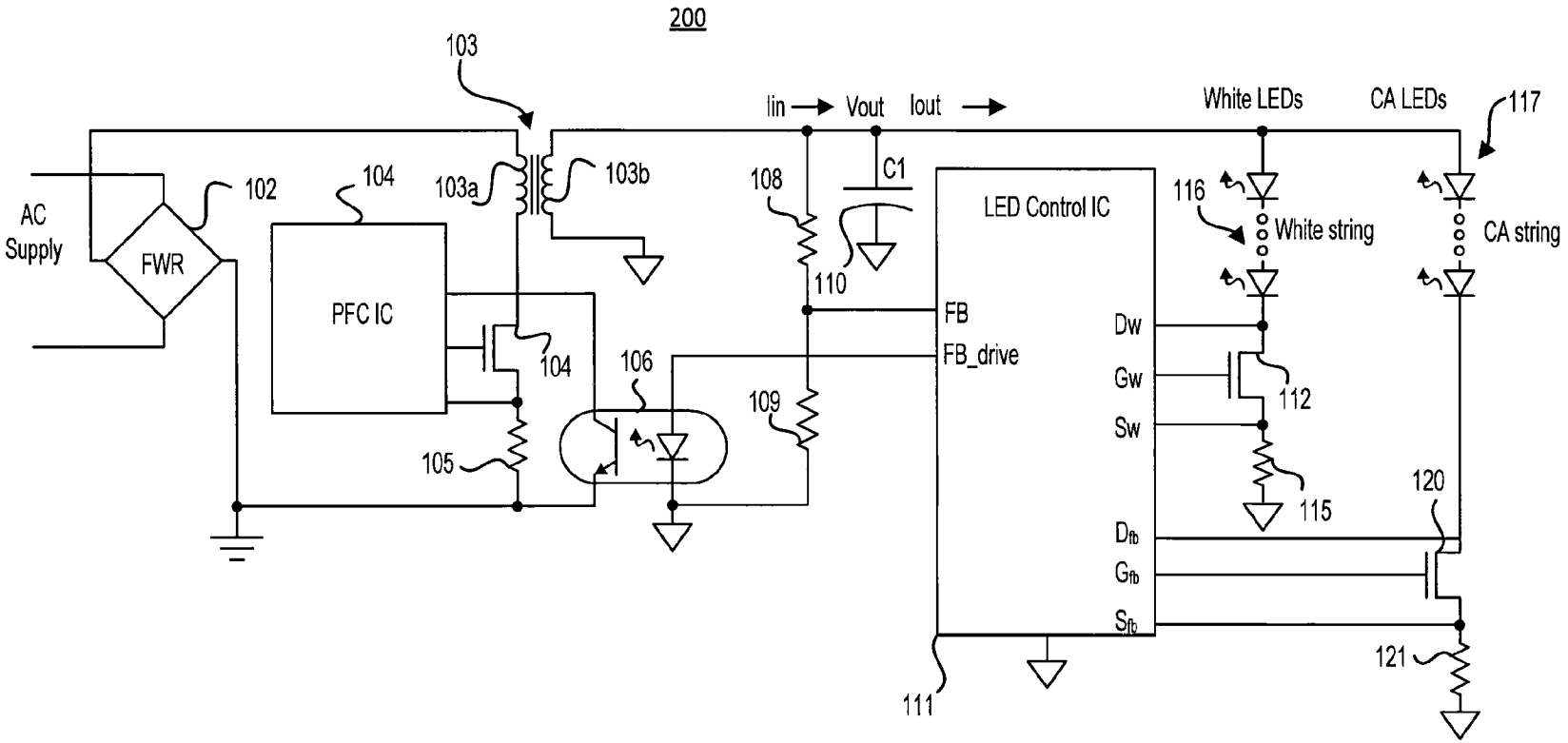
FIG. 2 is a simplified schematic diagram of an improved exemplary color correcting device driver.

FIG. 2 is a simplified schematic diagram of an exemplary color correcting device driver 200. Circuit 200 is similar, but not identical, to circuit 100. Specifically, the large and unreliable electrolytic capacitor 110, which is 3 mF to 10 mF, is replaced with a more reliable ceramic capacitor that is on the order of 500 to 1000 times smaller at 3 μF to 20 μF. Capacitor 110 was initially large to compensate for the current supplied by PFC controller 104 that is twice the line current. To allow for the reduction in the size of capacitor 110 device controller 111 can be configured to vary the current (Iout) provided by capacitor 110 into strings 116, 117 with the frequency of the incoming current (e.g., 120 Hz). Varying Iout with the incoming frequency, allows the current Iout to equal approximately the current (Iin) fed into capacitor 110. Some exemplary methods for doing this are described below with respect to FIG. 4.

In circuit 200, shunt regulator 107 has been removed and opto-coupler 106 is coupled directly to FB drive node. The equivalent of a shunt regulator is internal to device controller 111. Inductor 119 and recirculating diode 118 have also been removed from circuit 200, as these parts are no longer needed in this circuit configuration.

Exemplary Method I

Figure 3:
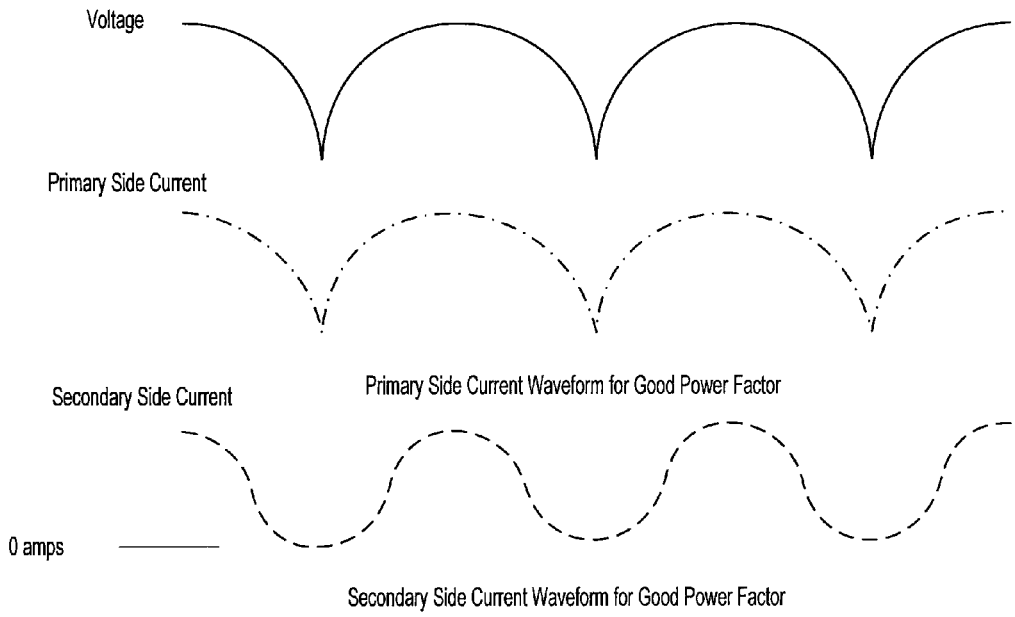
FIG. 3 illustrates exemplary primary and secondary side waveforms for the device driver of FIG. 2.

FIG. 3 illustrates exemplary primary side and secondary side waveforms for the device driver of FIG. 2. PFC controller 104 ensures that the primary and secondary side currents are in phase with the primary side voltage for a good power factor. Since the secondary side voltage is constant, the secondary current waveform must follow the shape of the power waveform for good PFC.

Figure 4:
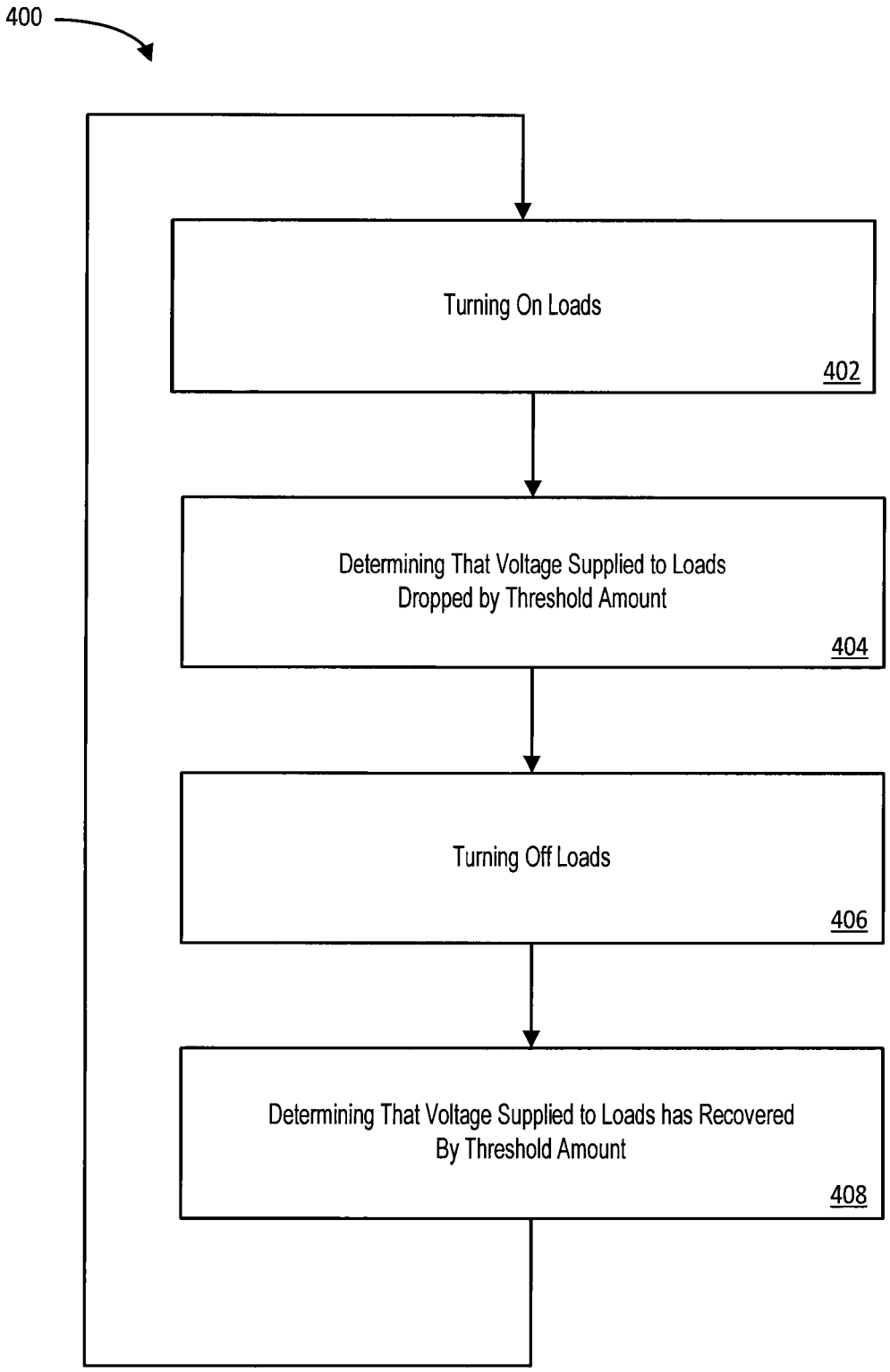
FIG. 4 is a flow diagram of a process for an improved color correcting device driver when a fly-back controller with PFC is used on the primary side of the transformer.

FIG. 4 is a flow diagram of a process 400 for an improved color correcting device driver for a fly-back controller with PFC on the primary side of the transformer, as shown in FIG. 2. In some implementations, process 400 can begin by turning on loads (402). Loads can be, for example, white and CA strings, 116, 117.

Process 400 can continue by determining if a voltage supplied to the loads has dropped by a first threshold amount (404), such as 500 mV. The voltage can be measured from a resistor divider from the output (resistors 108, 109), by observation of the Dw node of device controller 111 or by observation of the Dfb node of device controller 111. This has the effect of determining how much ripple is allowed on capacitor 110.

Process 400 can continue by turning off the loads (406) and determining if the voltage supplied to the loads has recovered by a second threshold amount (408) (e.g., 500 mV). For example, a recovery time can be a fixed amount of time (e.g., about 1 μs). Process 400 then returns to step 402 and repeats.

To vary the ratio of the white string to CA string duty cycles, the average PWM over the frequency of the AC input (e.g., 120 Hz) can be determined. Once the ratio is determined, CA string 117 can be turned off for the rest of the duty cycle and only white string 116 is pulse width modulated.

With process 400, if the current into capacitor 110 is equal to the current out of capacitor 110, then the voltage on capacitor 110 is DC. If the voltage on capacitor 110 is DC, then capacitor 110 can have a very small capacitance value. Since the ripple on capacitor 110 is regulated, capacitor 110 is kept at the correct DC voltage (plus some ripple), and only a small capacitor 110 is required to maintain the desired voltage.

When controller 104 on the primary side of transformer 103 does not include PFC, a good PFC can be obtained by creating the PWM using an n-level PWM approximation of a sine wave and synchronizing the sine wave to the AC input waveform.

Figure 5:
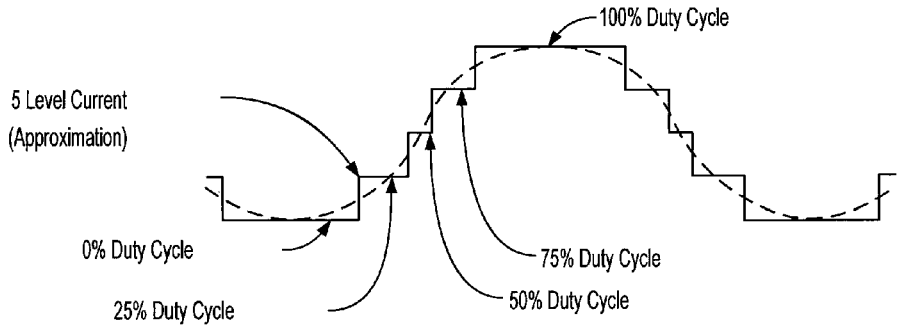
FIG. 5 illustrates a duty cycle in each region for a five level PWM approximation of a sine wave.

FIG. 5 illustrates a duty cycle in each region for a 5-level PWM approximation of a sine wave. To create the PWM approximation, the start time of the PWM and the frequency of the AC input (60 Hz in the US, 50 Hz in Europe), needs to be detected. The 5-level PWM approximation shown in FIG. 5 is an example PWM approximation. More or fewer levels can be used as required to provide an adequate PFC.

The start time and correct frequency for the current waveform can be determined by detecting zero crossings of the AC waveform or FWR waveform. The correct frequency can be determined by detecting two start times. Because a perfect power factor of one cannot be created, the AC waveform will be superimposed on the DC output at the secondary side. By monitoring the output voltage, we can determine the phase of the input and the correct phase to load the output. The output can be directly monitored through the FB pin. A comparator can detect the zero crossing. It may be desirable to AC couple the output to device controller 111 for a larger sense signal.

Additionally, a low pass filter can be added to remove the switching and PWM noise to improve the signal-to-noise (SNR) ratio in the zero crossing detector. Alternatively, Dfb or Dw can be used to sense the output.

Typically, a non-PFC controller (e.g., a standard controller) requires a large hold capacitor on the primary side of transformer 103 to provide power when the AC voltage drops (in the valleys of the rectified AC voltage). Because circuit 200 draws current in the correct phase/frequency for good PFC, a hold capacitor on the primary side of transformer 103 is not necessary, although a small capacitor can be added for electromagnetic interference (EMI). Because the hold capacitor is very small, the secondary voltage will drop significantly under any load near the valleys of the AC input. This signal can be used to synchronize both the phase and the frequency of the LED loads.

Removing Large Inductor L1

Circuit 100 includes a floating buck topology as a power converter. Such a configuration includes inductor 119 and recirculating diode 118 (e.g., Schottky diode). Circuit 200 can be configured without the large inductor (L1) of circuit 100, which can be about 800 μH. Instead of using 20V and 150 mA LEDs for CA string 117, inductor 119 can be removed and lower current LEDs can be used for CA string 117. For example, white string 116 can be 40V and 350 mA (14 watts) and CA string 117 can be 20V and 15 mA (3 watts). Eleven 85 mA LEDs in CA string 117 in series requires about 36.7V but uses 40V. This uses a total of 17.4 mA for a loss of just 2.3%. Accordingly, with 10 or 11 diodes in CA string 117, the loss is so small that it can be more efficient than the floating buck configuration used in circuit 100. It is not necessary to use lower current LEDs in CA string 117 to get the higher efficiency if the number of series connected LEDs is set to the correct valued described above. If a higher current LED is used, the duty cycle can be reduced accordingly to get the correct average light output required. However, there is typically a cost savings associated with lower current LEDs.

While this document contains many specific implementation details, these should not be construed as limitations on the scope what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub combination. Moreover, although features may be described above as acting in certain combinations and even initially claimed as such, one or more features from a claimed combination can, in some cases, be excised from the combination, and the claimed combination may be directed to a sub combination or variation of a sub combination.

What is claimed is:

1. A circuit comprising:

a rectifier configured for rectifying an alternating input voltage and providing an incoming current;

a transformer coupled to the rectifier and having a primary coil and a secondary coil;

a capacitor coupled to the secondary coil and configured for coupling to a white string of light emitting elements and a color-adjusted (CA) string of light emitting elements;

a power factor correction (PFC) controller coupled to the primary coil and configured for providing PFC; and a device controller coupled to the secondary coil and configured for coupling to the white string of light emitting elements and the CA string of light emitting elements, the device controller configured to generate pulse width modulated (PWM) commands to transistors coupled in series with the white and CA strings to vary current into the white and CA strings with a frequency of the incoming current.

2. The circuit of claim 1, where the capacitor is less than 3 mF.

3. The circuit of claim 1, where the device controller is configured to pulse current into the white and CA strings such that the average of the pulses is sinusoidal at the frequency of the incoming current.

4. The circuit of claim 1, where the light emitting elements are light emitting diodes.

5. The circuit of claim 1, a zero crossing detector coupled to the secondary coil and to the PFC controller for indicating when the alternating voltage passes through a point near zero.

6. A method performed by a driver circuit, the method comprising:

turning on loads coupled to the driver circuit using the driver circuit;

determining that a voltage supplied to the strings has dropped by a first threshold amount;

turning off the loads using the driver circuit; and determining that the voltage supplied to the strings has recovered by a second threshold amount; and responsive to the voltage recovering, repeating the method.

7. The method of claim 6, where determining that the voltage has recovered by a second threshold amount further comprises waiting a fixed period of time.

8. The method of claim 6, where the loads include a string of white light emitting elements and a string of color-adjusted (CA) light emitting elements.

9. The method of claim 8, where turning on or off the loads is performed by a first transistor coupled in series with the white string and a second transistor coupled in series with the CA string, and the method further comprises:

commanding the first and second transistors on and off by pulse width modulated waveforms according to respective first and second duty cycles.

10. The method of claim 9, further comprises:

varying a ratio of the first and second duty cycles based a pulse width modulation averaged over the frequency of an alternating voltage to the driver circuit.

11. The method of claim 10, furthering comprising:

turning off the CA string for a portion of the second duty cycle while still commanding the first transistor according to the first duty cycle.

12. The method of claim 6, where the first and second thresholds amounts are the same.

13. A system for driving illuminating elements, the system comprising:

one or more strings of white light emitting elements;

one or more strings of color-adjusting (CA) light emitting elements coupled in parallel with the strings of white light emitting elements;

one or more driver circuits coupled to the one or more white and CA strings, at least one of the driver circuits further comprising:

a rectifier configured for rectifying an alternating input voltage and providing an incoming current;

a transformer coupled to the rectifier and having a primary coil and a secondary coil;

a capacitor coupled to the secondary coil and configured for coupling to the white string of light emitting elements and the color-adjusted (CA) string of light emitting elements;

a power factor correction (PFC) controller coupled to the primary coil and configured for providing PFC; and a device controller coupled to the secondary coil and configured for coupling to the white string of light emitting elements and the CA string of light emitting elements, the device controller configured to generate pulse width modulated (PWM) commands to transistors coupled in series with the white and CA strings to vary current into the white and CA strings with a frequency of the incoming current.

14. The system of claim 13, where the capacitor is less than 3 mF.

15. The display panel of claim 13, where the device controller is configured to pulse current into the white and CA strings such that the average of the pulses is sinusoidal at the frequency of the incoming current.

16. The system of claim 13, where the light emitting elements are light emitting diodes.

17. The system of claim 13, a zero crossing detector coupled to the secondary coil and to the PFC controller for indicating when the alternating voltage passes through a point near zero.

18. A system for driving light emitting elements, the system comprising:

means for turning on loads coupled to the driver circuit using the driver circuit;

means for determining that a voltage supplied to the elements has dropped by a first threshold amount;

means for turning off the loads using the driver circuit; and means for determining that the voltage supplied to the elements has recovered by a second threshold amount and responsive to the voltage recovering repeating the method.

* * * * *

UNITED STATES PATENT AND TRADEMARK OFFICE

CERTIFICATE OF CORRECTION

PATENT NO. : 8,575,863 B2
APPLICATION NO. : 13/291943
DATED : November 5, 2013
INVENTOR(S) : Cai et al.

It is certified that error appears in the above-identified patent and that said Letters Patent is hereby corrected as shown below:

In the Claims

Column 6, Claim 5, Line 17:

After "The circuit of claim 1,"
Insert -- further comprising: --.

Column 8, Claim 17, Line 3:

After "The system of claim 13,"
Insert -- further comprising: --.

Signed and Sealed this
Twenty-fifth Day of November, 2014

Michelle K. Lee

Michelle K. Lee
*Deputy Director of the United States Patent and Trademark Office*